US007257320B2

(12) United States Patent
Hartge

(10) Patent No.: US 7,257,320 B2
(45) Date of Patent: Aug. 14, 2007

(54) METHOD AND APPARATUS FOR OPERATING AN ELECTRIC WATER HEATER

(75) Inventor: Robert Hartge, Shelby, OH (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 18 days.

(21) Appl. No.: 11/328,520

(22) Filed: Jan. 9, 2006

(65) Prior Publication Data

US 2007/0157634 A1 Jul. 12, 2007

(51) Int. Cl.
*F24H 1/20* (2006.01)

(52) U.S. Cl. ..... 392/451; 392/498

(58) Field of Classification Search ..... None
See application file for complete search history.

(56) References Cited

U.S. PATENT DOCUMENTS 4,598,694 A * 7/1986 Cromer ..... 122/19.1
4,739,728 A * 4/1988 Kale ..... 122/19.1
5,921,207 A * 7/1999 DiSalvo et al. ..... 122/388
6,208,806 B1 * 3/2001 Langford ..... 392/464
6,363,216 B1 * 3/2002 Bradenbaugh ..... 392/463
6,374,046 B1 * 4/2002 Bradenbaugh ..... 392/463
7,117,825 B2 * 10/2006 Phillips ..... 122/4 A
2001/0031138 A1 * 10/2001 Troost ..... 392/498
2005/0147401 A1 * 7/2005 Baxter ..... 392/454
2006/0013572 A1 * 1/2006 Phillips ..... 392/459
2007/0034169 A1 * 2/2007 Phillips ..... 122/14.1

* cited by examiner

*Primary Examiner*—Thor Campbell
(74) *Attorney, Agent, or Firm*—Harness, Dickey & Pierce, PLC

(57) ABSTRACT

A control system for an electric water heater having an upper heating element and a lower heating element includes a control module that controls operation of the electric water heater by selectively toggling the upper and lower heating elements between an ON state and an OFF state. The control module maintains a stratification of water within the water heater including a first volume maintained at a set point temperature and a second volume held at a setback temperature, which is less than the set point temperature. The setback temperature is low enough to maintain the stratification yet high enough to allow the upper heating element to heat water from the second volume to the set point temperature prior to exiting the water heater.

27 Claims, 6 Drawing Sheets

METHOD AND APPARATUS FOR OPERATING AN ELECTRIC WATER HEATER

FIELD OF THE INVENTION

The present invention relates to electric water heaters and more particularly to a control system for controlling an electric water heater for energy efficiency.

BACKGROUND OF THE INVENTION

Electric water heaters are conventionally used in residential and commercial buildings to supply the occupants of the building with a reservoir of hot water. The water heater typically includes a tank that is fluidly coupled to a water supply of the building at an inlet and is fluidly coupled to building fixtures such as faucets, showers, and dishwashers at an outlet. The water heater tank receives cold water from the building water supply at the inlet and heats the water to a set point temperature using lower and upper heating elements. The lower and upper heating elements raise the temperature of the water disposed within the water heater tank to the set point temperature by converting current from a building power supply into radiant heat. The heated water is stored within the tank and is held at the set point temperature by the heating elements so that a supply of hot water is constantly and consistently provided at a desired temperature.

Conventional electric water heaters typically include a control system that monitors a temperature of water disposed within the water tank to ensure that the water contained therein is maintained at a predetermined set point temperature. The set point temperature is typically a consumer-selected setting that allows the consumer to determine a temperature of the hot water to be produced by the water heater. The control system continuously monitors the temperature of the water within the tank via a temperature sensor and compares the sensed temperature to the set point temperature. The control system generally includes an upper temperature sensor associated with the upper heating element and a lower temperature sensor associated with the lower heating element. The upper temperature sensor and lower temperature sensor each provide information regarding the water temperature near the respective elements. The respective sensors, in combination with the upper and lower heating elements, allow the control system to selectively heat the water disposed within the tank when the sensed temperature falls below the set point temperature.

In operation, the upper heating element of a conventional electric water heater is energized by the control system to heat a volume of water generally between the upper heating element and a top of the tank (i.e., an upper zone of the tank). Once the water in the upper zone of the tank is at the set point temperature, the control system de-energizes the upper heating element and energizes the lower heating element. The lower heating element heats a volume of water generally above the lower heating element and below the upper heating element (i.e., a lower zone of the tank). The lower heating element remains energized until the water within the lower zone of the tank is at the set point temperature.

Water, when heated, rises due to the physical properties (i.e., density) of heated water relative to the cooler water within the tank. Therefore, as the lower heating element heats water, the heated water rises within the tank and cold water descends toward the lower heating element. The descending cold water mixes with the passing hot water and is heated by the lower heating element. This process continues until the entire volume of water disposed within the lower zone of the tank reaches the set point temperature.

When a consumer draws hot water from the tank, the initial hot water drawn from the tank outlet is disposed within the top zone of the tank, near the upper heating element and upper temperature sensor. When the hot water exits the tank, a fresh supply of cold water is introduced into the tank at an inlet. The inlet is generally disposed at a bottom of the tank, below the lower heating element. The incoming cold water eventually contacts the lower heating element as the hot water is displaced (i.e., drawn from the tank at the outlet). At this point, the lower temperature sensor detects the influx of cold water and relays the information to the control system. The control system processes the information from the lower temperature sensor and energizes the lower heating element to heat the incoming cold water until the set point temperature is achieved.

If the consumer does not use all of the hot water available in the tank, the lower heating element remains energized and continues to heat the water (as described above) until the set point temperature is reached. However, there are instances when the consumer draws a sufficient volume of hot water from the tank such that the volume of cold water entering the tank reaches the upper heating element. Such an occurrence is known as a "deep draw" event. A deep draw event is identified when the upper temperature sensor detects a significant drop in temperature due to the incoming cold water. Upon detection of the incoming cold water, the control system de-energizes the lower heating element and energizes the upper heating element in an effort to quickly heat the cold water to the set point temperature before the water exits the tank.

When the consumer stops using hot water, the influx of cold water is similarly stopped. At this point, the upper heating element continues to heat water disposed in the upper zone of the tank until the upper temperature sensor detects that the water disposed in the upper zone is at the set point temperature. The control system then de-energizes the upper heating element and energizes the lower heating element to heat the water disposed within the lower zone of the tank. The lower heating element remains energized until the lower temperature sensor detects that the temperature of the water disposed within the lower zone is at the set point temperature. In this manner, conventional hot water heaters include a control system that responds to a draw of hot water from the tank by continually heating the entire volume of water disposed within the tank to the set point temperature.

The capacity of an electric water heater is conventionally understood as the volume of water that the water heater is able to heat and maintain at a set point temperature. For example, an eighty-gallon water heater can heat and store eighty gallons of water. In this regard, then, the capacity of the eighty-gallon water heater is eighty gallons.

The effective capacity of the water heater that is realized by a consumer, however, is greater than the simple volume capacity of the water heater that was just described. This is so because a consumer does not typically use water at the set point temperature when a call for "hot water" at a household fixture is made. While the set point temperature for a water heater can vary, it is not uncommon that the set point is at 120° F. or higher. A consumer demand for "hot water" at a fixture, however, generally is for water at a comfortable temperature that is well below the set point temperature. Consequently, in order to produce the "hot water" that is used by the consumer, water drawn from the water heater is mixed with cold water from the building water supply. Thus, for example, for every gallon of "hot water" that is used by the consumer, only a half-gallon of water is drawn from the water heater. This effectively increases the amount of "hot water" that the electric water heater can provide to a consumer.

As a general proposition, the higher the set point temperature of the water heater, the lower the volume of water that needs to be drawn from the water heater in order to produce "hot water" for the consumer. Similarly, the lower the set point temperature of the water heater, the higher the volume of water that needs to be drawn from the water heater in order to produce "hot water" for the consumer. Thus, the effective capacity of the water heater can be adjusted by raising or lowering the set point temperature of the water heater. For example, a lower set point temperature would require more water from the water heater to produce the desired "hot water." Thus, hot water from the water heater is used faster and the effective capacity of the system is reduced. Conversely, raising the set point temperature would require less water from the water heater to provide the same "hot water." Increasing the set point temperature, therefore, increases the capacity of the water heater.

Conventional water heaters, as previously discussed, include a control system that maintains water disposed therein at a relatively high temperature to maximize effective capacity and provide the consumer with the greatest volume of "hot water." The high set point temperature requires frequent cycling of the upper and lower heating elements to maintain water disposed in the water heater at the set point temperature, as heat loss through tank walls becomes greater at higher temperatures. Therefore, while a high set point temperature is desirable from an effective capacity standpoint, the high temperatures require frequent cycling of the upper and lower heating elements. Cycling of the upper and lower heating elements increases energy consumption and therefore reduces the overall energy efficiency of the water heater.

Therefore, a controller for an electric water heater that provides a consumer with a maximum effective capacity while concurrently providing a decrease in energy costs is desirable in the industry. Furthermore, a controller for an electric water heater that satisfies increasingly stringent government energy standards, while concurrently providing a consumer with a maximum effective capacity of hot water, is also desirable.

SUMMARY OF THE INVENTION

Accordingly, a control system for an electric water heater having an upper heating element and a lower heating element is provided. The control system includes a control module that controls operation of the electric water heater by selectively toggling the upper and lower heating elements between an ON state and an OFF state. The control module maintains a stratification of water within the water heater including a first volume maintained at a set point temperature and a second volume held at a setback temperature, which is less than the set point temperature. The setback temperature is low enough to maintain the stratification yet high enough to allow the upper heating element to heat water from the second volume to the set point temperature prior to exiting the water heater.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
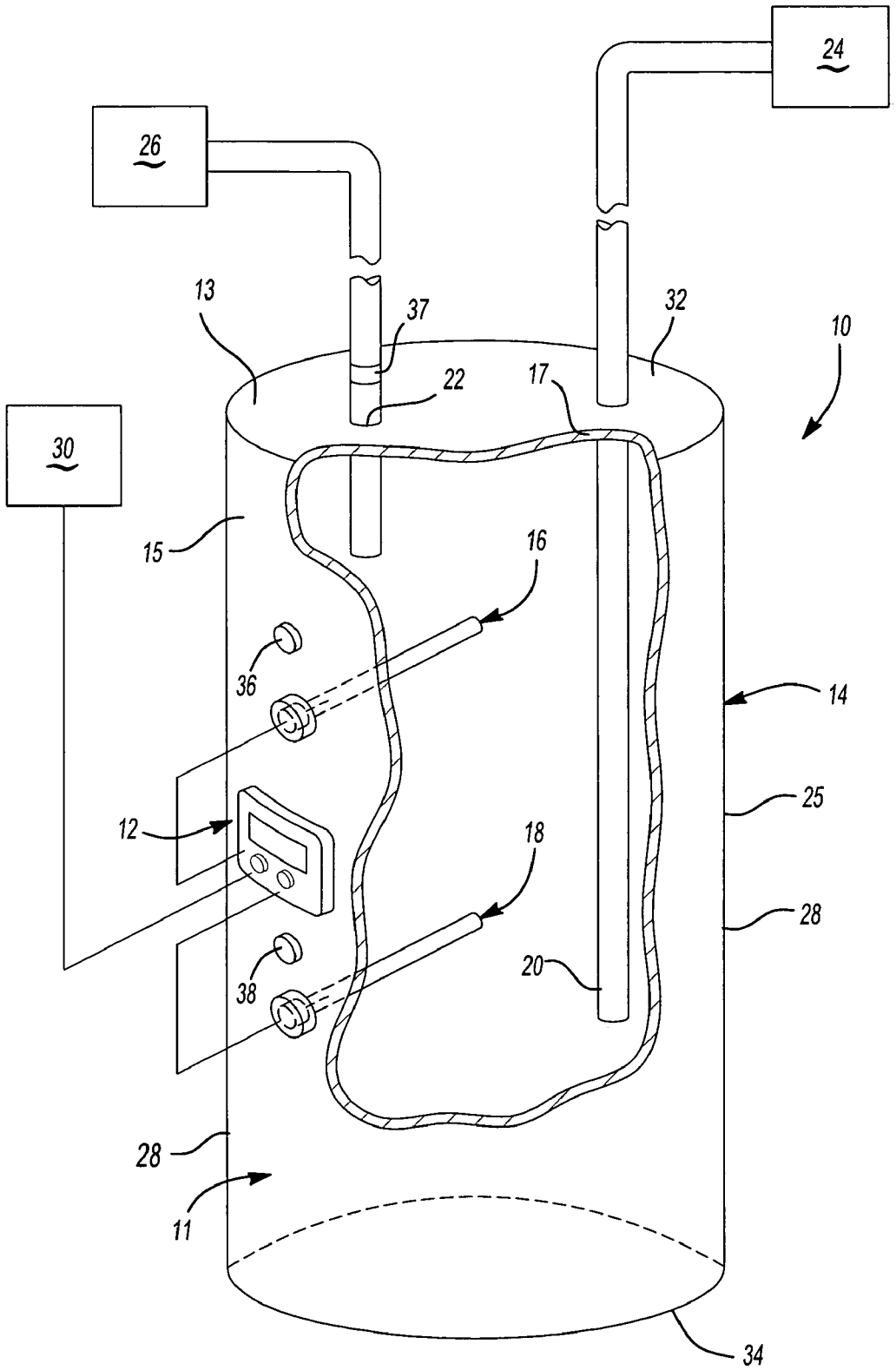
FIG. 1 is a schematic representation of an electric water heater that is operated in accordance with the principals of the present invention.

The following description of the preferred embodiment(s) is merely exemplary in nature and is in no way intended to limit the invention, its application, or uses.

With reference to the figures, an electric water heater 10 is provided and includes a control module 12. The control module 12 continually monitors the water heater 10 to ensure that a stratification layer exists between an upper portion of the water heater 10 and a lower portion of the water heater 10 to optimize efficiency and capacity. As used herein, the term module refers to an application specific integrated circuit (ASIC), an electronic circuit, a processor (shared, dedicated, or group), and memory that execute one or more software or firmware programs, a combinational logic circuit, and/or other suitable components that provide the described functionality.

The control module 12 maintains water at an upper region 13 of the water heater 10 at a set point temperature and maintains water disposed in a lower region 15 of the water heater 10 at a lower temperature. A stratification layer 17 is formed within the water heater 10 such that water at the set point temperature is separated from the cooler water in the lower portion 15. The lower-temperature water is maintained at a temperature that is just high enough to allow the water heater 10 to heat the water to the set point temperature prior to its use by the consumer. The set point temperature is typically a consumer-selected setting that allows a consumer to select a temperature of the hot water produced by the water heater 10.

The stratification of water within the heater 10 is caused by the physical properties of water and is the result of having a body of water at a first temperature disposed within the same tank as a body of water at a second temperature, which is less than the first temperature. Specifically, when water within the water heater 10 is heated, the heated water rises due to the density of the heated water relative to the cooler water. The rise of the heated water separates the heated water from the cooler water and therefore creates the stratification layer 17 within the water heater 10. The stratification layer 17 is generally maintained if the temperature difference between the heated water disposed within region 13 and the cooler water disposed within region 15 is at least ten degrees Fahrenheit. If the difference in temperature between the two regions 13, 15 is less than about ten degrees Fahrenheit, the regions 13, 15 will tend to mix together and the stratification of the water within the heater 10 will be lost.

The control module 12 causes water disposed within region 13 to be heated to the set point temperature under static conditions (i.e., when water is not being drawn from the water heater 10). Under dynamic conditions (i.e., when water is drawn from the water heater 10), the control module 12 causes water entering region 13 from region 15 to be heated to the set point temperature prior to immediate use by the consumer. In so doing, heat loss through the walls of the water heater 10 is reduced as water within region 15 is maintained at a reduced temperature and therefore experiences less heat loss through the walls of the water heater 10 than a similar body of water held at a higher temperature. Therefore, maintenance of the stratification layer provides the water heater 10 with an increase in efficiency as only that amount of water which is drawn by the consumer is heated to the set point temperature.

With reference to FIG. 1, the electric water heater 10 is shown and includes a tank 14, an upper heating element 16, and a lower heating element 18. The tank 14 defines an inner volume 11 and includes an inlet 20 and an outlet 22, both fluidly coupled to the inner volume 11. The inlet 20 is fluidly coupled to a building water supply 24 while the outlet 22 is connected to building fixtures such as faucets and showers, schematically represented as 26 (FIG. 1). In this manner, the inlet 20 receives a constant supply of cold water under pressure from the building water supply 24 such that the inner volume 11 of the tank 14 is always full of water. Water only exits the tank 14 via outlet 22 when water is consumed at one of the fixtures 26 throughout the building. Therefore, cold water only enters the tank 14 when hot water is consumed (i.e., exits the tank 14 via outlet 22).

The upper heating element 16 extends through a side wall 28 of the tank 14 and generally into the inner volume 11. The upper heating element 16 is electrically connected to a building power supply 30 and is disposed near to an upper wall 32 of the tank 14. The upper heating element 16 receives current from the power supply 30 via control module 12 such that the control module 12 regulates the upper heating element 16 between an ON state and an OFF state.

The lower heating element 18 extends through the side wall 25 of the tank 14 and generally into the inner volume 11. The lower heating element 16 is electrically connected to the building power supply 30 and is disposed near to a lower wall 34 of the tank 14 such that the lower heating element 18 is generally closer to the lower wall 34 of the tank 14 than the upper heating element 16 is to the upper wall 32. The lower heating element 18 receives current from the power supply 30 via control module 12 such that the control module 12 regulates the lower heating element 18 between an ON state and an OFF state.

The electric water heater 10 also includes a sensor module 35 in communication with the control module 12. The sensor module 35 comprises an upper temperature sensor 36 and a lower temperature sensor 38. The upper temperature sensor 36 and lower temperature sensor 38 are each in communication with the control module 12, such that readings from the upper and lower temperature sensors 36, 38 are transmitted to the control module 12 for processing.

The upper temperature sensor 36 is disposed adjacent to the upper heating element 16 to monitor a temperature of water within the upper region 13 of the tank 14. The upper region 13 extends generally between the upper heating element 16 and the upper wall 32 (FIG. 1). The lower temperature sensor 38 is disposed adjacent to the lower heating element 18 to monitor a temperature of water within the lower region 15 of the tank 14. The lower region 15 extends generally between the lower heating element 18 and the upper heating element 16. The temperature sensors 36, 38 are preferably thermistors, such as an NTC thermistors, but could be any suitable temperature sensor that accurately reads the temperature of the water within the tank 14.

In addition to the foregoing, the sensor module 35 could also comprise two or more upper temperature sensors 36 disposed near the upper heating element 16. The redundant temperature sensors 36 may provide redundant temperature readings at the upper heating element 16 to confirm a water temperature at the upper portion of the tank 14. During operation of such an embodiment, the control module 12 receives information from the sensors 36 for use in selectively actuating the upper heating element 16 to the ON state. The control module 12 receives information from the sensors 36 and determines whether to toggle the upper heating element 16 to the ON state based on the highest temperature value received. In addition, the control module 12 compares the respective temperature values and, if the difference between any two sensors 36 is above a predetermined value, a sensor fault is detected and the water heater 10 is shut down for maintenance.

Furthermore, the sensor module 35 could also include a flow sensor 37 disposed at the inlet 20 or the outlet 22 of the tank 14 to monitor a flow of water entering or exiting the tank 14. The flow sensor 37 may be used to indicate exactly how much water has been consumed over a predetermined amount of time. Therefore, the flow sensor 37 may be used in determining when the upper and lower heating elements 16, 18 should be toggled to the ON state to heat water disposed within the tank 14.

Figure 2:
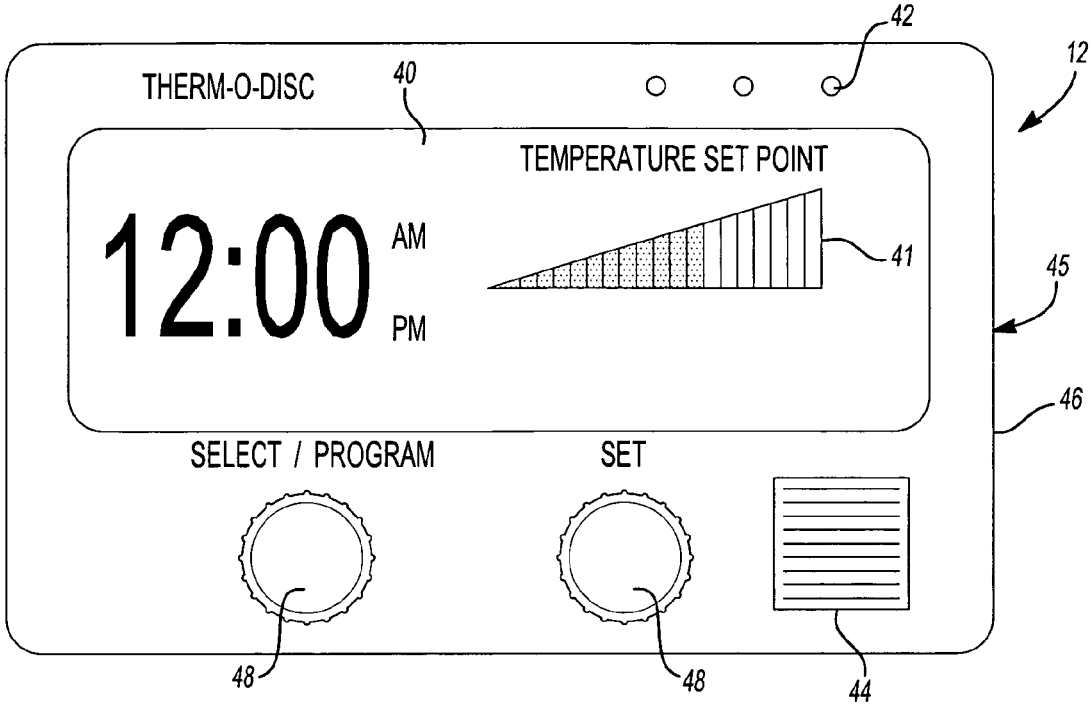
FIG. 2 is a schematic representation of a consumer interface module of the electric water heater of FIG. 1.

With reference to FIG. 2, the control module 12 includes a consumer interface module 45 having a liquid crystal display (LCD) 40, a series of light-emitting devices (LED) 42, and a speaker 44. The LCD 40, LED 42, and speaker 44 are all contained within a control module housing 46. The LCD 40 displays the operating parameters of the electric water heater 10 such as a current temperature set point (represented by bar graph 41) and other useful information such as date and time. In addition, the LCD 40 may be backlit to allow use of the control module 12 in a dark or dimly-lit basement. The LED 42 are positioned adjacent to the LCD 40, but may also be incorporated into the LCD 40 to visually indicate operating parameters of the electric water heater 10. The speaker 44 allows the control module 12 to audibly alert a consumer of a particular condition of the water heater 10. In addition to the foregoing, the control module 12 also includes at least one button 48 allowing a consumer to communicate with the consumer interface module 45.

Figure 3A:
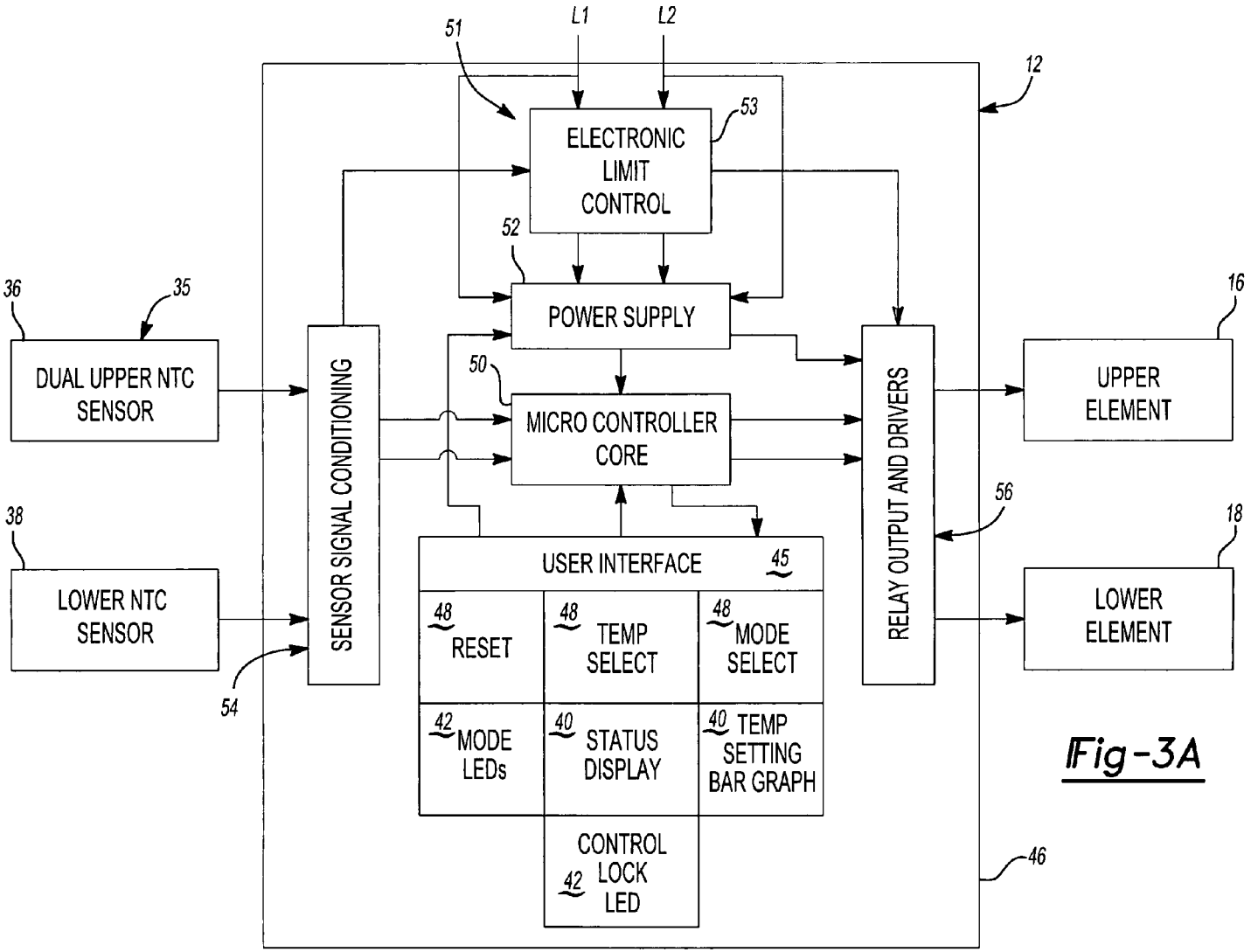
FIG. 3A is a schematic representation of a control module incorporating an electronic upper limit sensor for an electric water heater in accordance with the principles of the present invention.

Turning to FIG. 3A, the control module 12 also comprises a microcontroller 50 in communication with the sensor module 35 and the consumer interface module 45. The microcontroller 50 is powered by a power supply 52 disposed generally within the control module housing 46. The power supply 52 receives power from line voltages L1, L2.

Figure 3B:
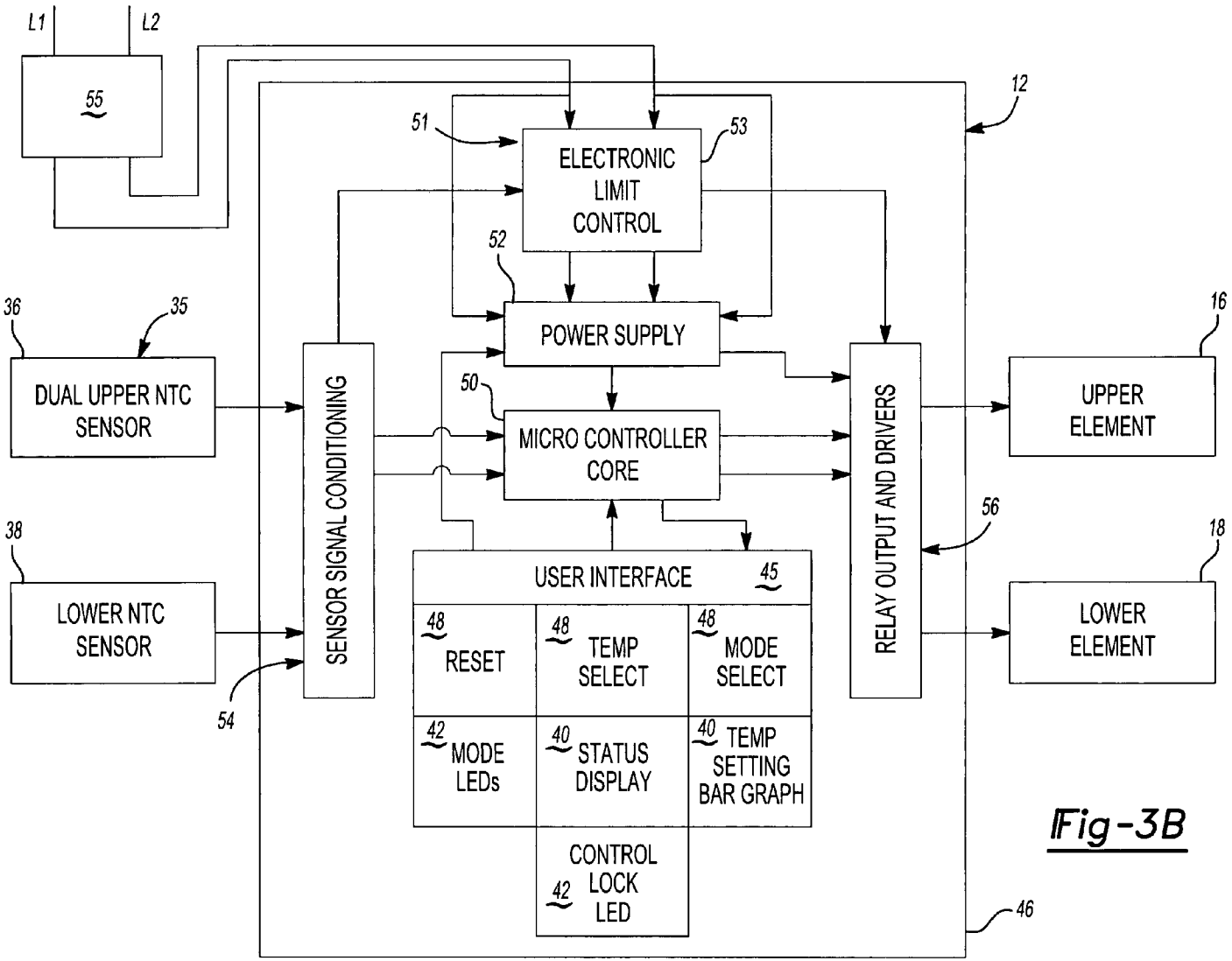
FIG. 3B is a schematic representation of a control module incorporating a bimetal upper limit switch and an electronic upper limit sensor for an electric water heat in accordance with the principles of the present invention.

A limit control module 51 controls power to the heating elements 16, 18 based on readings from the upper and lower temperature sensors 36, 38. The limit control module 51 of FIG. 3A is shown as an electronic limit control module 53 and essentially acts as a backup device to the microcontroller 50. For example, if the microcontroller 50 fails to cut power to the upper and lower heating elements 16, 18, the electronic limit control module 53 shuts down the heating elements 16, 18 based on readings from the upper and lower temperature sensors 36, 38. The limit control module 51 could also include a bimetal snap disc thermostat 55, as shown in FIG. 3B. The bimetal snap disc thermostat 55 receives line voltages L1, L2 and selectively prevents power from reaching the upper and lower heating elements 16, 18.

In either of the foregoing configurations, the limit control module 51 is a separate circuit from the microcontroller 50 and selectively cuts power to the upper and lower heating elements 16, 18 based on readings from the upper and lower temperature sensors 36, 38. The limit control module 51 only cuts power to the upper and lower heating elements 16, 18 when the microcontroller 50 fails to do so based on readings from the upper and lower temperature sensors 36, 38.

Figure 4:
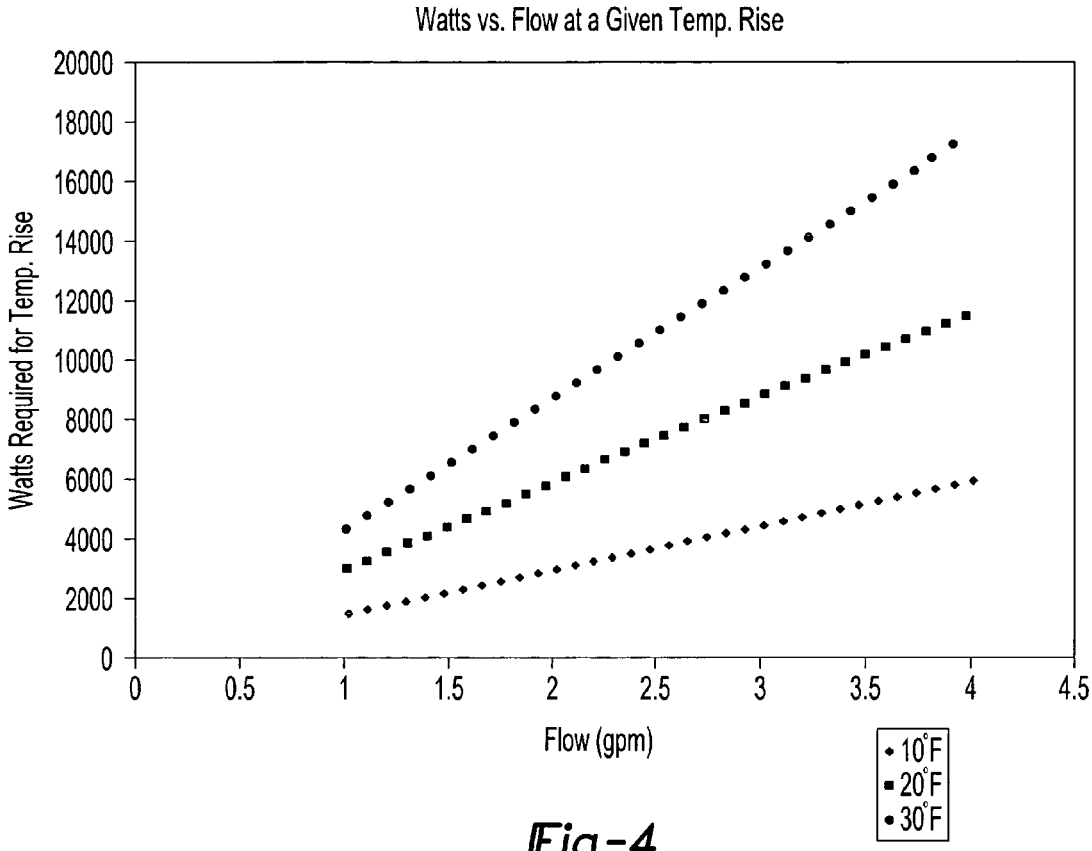
FIG. 4 is a graph showing wattage drawn by an upper heating element versus flow rate for three exemplary setback temperatures.

With reference to FIGS. 2-4, operation of the water heater 10 and associated control module 12 can be best understood. When the water heater 10 is initially installed, the tank 14 is completely filled with cold water from the building water supply 24 via inlet 20. At this point, all of the water disposed within the tank 14 is substantially at the same temperature (i.e., cold). The upper temperature sensor 36 senses the cold temperature and relays the information to the control module 12 for processing. The control module 12 energizes the upper heating element 16 to thereby heat water within region 13 to the set point temperature. Once the water disposed within region 13 reaches the set point temperature, the control module 12 de-energizes the upper heating element 16.

Once the upper heating element 16 is de-energized, the control module 12 determines the temperature of the water disposed within region 15 via lower temperature sensor 38. The control module 12 energizes the lower heating element 18 to heat water within region 15 to a setback temperature that is at least about ten degrees Fahrenheit below the set point temperature.

In so doing, the control module 12 creates the stratification layer 17 generally between regions 13 and 15. As previously discussed, the stratification layer 17 is best maintained if the temperature difference between the respective regions 13, 15 is about ten degrees Fahrenheit or greater. The control module 12, therefore, maintains the temperature difference to ensure stratification but not so great as to prohibit the upper heating element 16 from heating the water to the set point temperature prior to use by the consumer.

Figure 5:
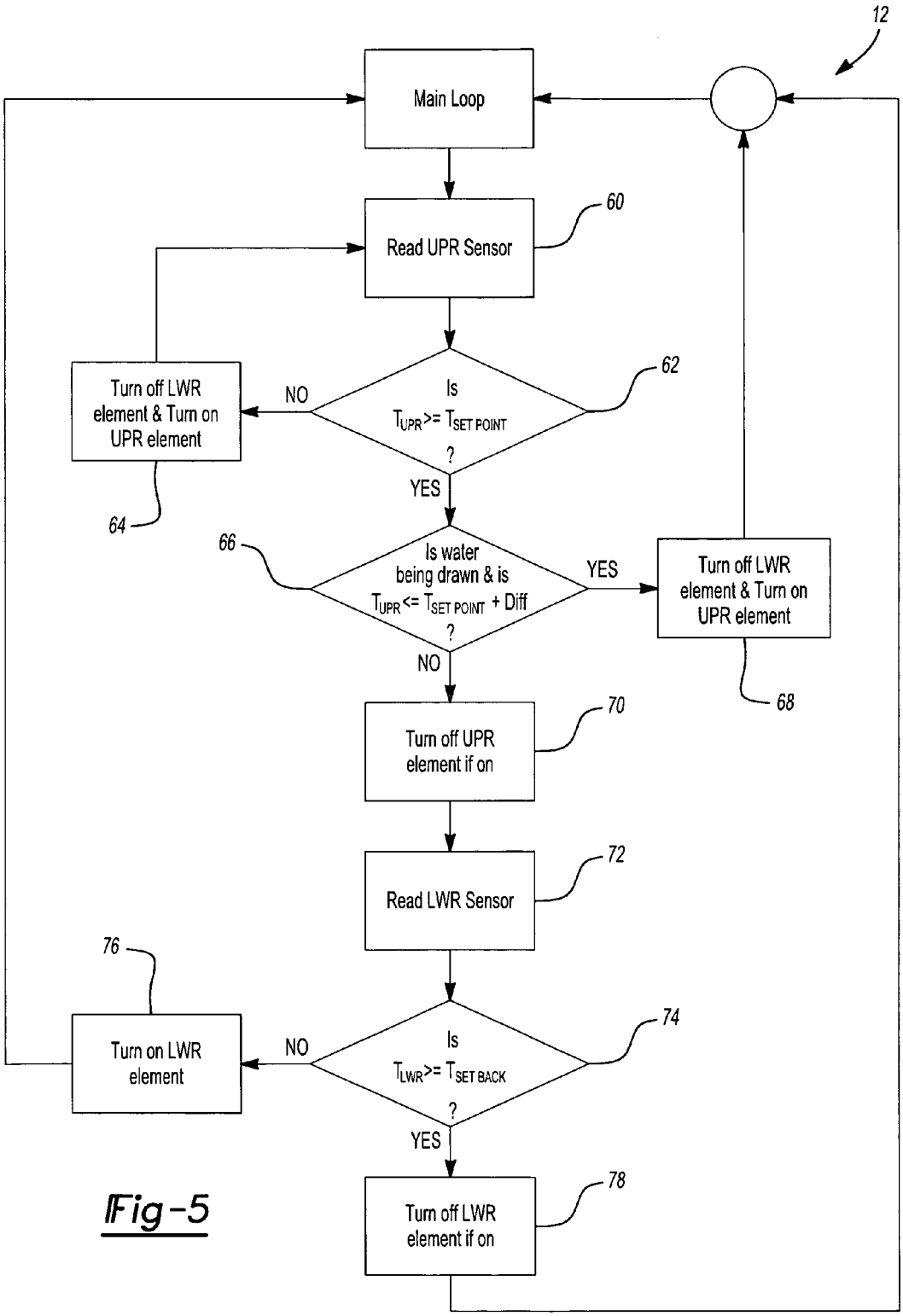
FIG. 5 is a flowchart that illustrates a control module for an electric water heater in accordance with the principals of the present invention.

With particular reference to FIGS. 4 and 5, operation of the water heater 10 is illustrated. Once the water heater 10 is installed and filled with cold water from the building water supply 24, the control module 12 continually monitors the water temperature at the upper and lower temperature sensors 36, 38. The control module 12 first reads the upper temperature sensor 38 to determine a water temperature generally within region 13 at 60. The temperature reading at the upper temperature sensor 36 is then compared to the set point temperature at 62. If the temperature at the upper temperature sensor 38 is not greater than the set point temperature, the lower heating element 16 is de-energized (if currently energized) and the upper heating element 18 is energized at 64. The upper heating element 16 remains energized until the upper temperature sensor 36 returns a temperature reading that is equal to, or greater than, the set point temperature.

If the temperature at the upper temperature sensor 36 is greater than or equal to the set point temperature, the control module 12 then determines if the temperature of the water at the upper temperature sensor 36 is less than or equal to the set point temperature plus a temperature differential, and if water is being drawn from the tank 14 at 66. The temperature differential is a calculated value used to adjust the measured temperature such that the measured temperature value closely approximates the actual temperature of the water.

If the water temperature at the upper temperature sensor 36 is less than or equal to the set point temperature and water is being drawn from the tank 14, the control module 12 de-energizes the lower heating element 18 (if currently energized) and energizes the upper heating element 16 at 68. The upper heating element 16 is energized to heat the water disposed within region 13 to the set point temperature prior to the water exiting the tank 14. When the consumer draws hot water from the tank 14, the initial water drawn is from region 13. When the water is drawn from region 13, water exits at the set point temperature while cold water replenishes the drawn water at the inlet 20.

The influx of cold water near the lower wall 34 causes the cooler water disposed within region 15 to rise and approach the outlet 22. The upper heating element 16 is energized to heat the rising water from region 15 to the set point temperature prior to the water exiting the tank 14 at outlet 22. For this reason, the cooler water disposed within region 15 must be held sufficiently close to the set point temperature to ensure that the upper heating element 16 can quickly heat the cooler water to the set point temperature prior to the water exiting the tank 14 at the outlet 22.

FIG. 4 shows a representative graph of wattage used by the upper heating element 16 versus flow rate for three setback temperatures (i.e., 10, 20, and 30 degrees Fahrenheit). Conventional heating elements are generally limited to roughly 6000 watts due to the limitations of residential power supplies. Therefore, the maximum setback temperature at a given flow rate is generally limited to a 6000 watt heating element.

At 6000 watts, a setback temperature of ten degrees Fahrenheit allows a consumer to draw hot water from the tank 14 at a rate of roughly four gallons per minute. At four gallons per minute, the upper heating element 16 is still able to heat the cooler water from region 15 to the set point temperature prior to the water being drawn at the outlet 22. Conversely, at 6000 watts, a setback temperature of thirty degrees Fahrenheit only allows the consumer to draw hot water from the tank 14 at a rate of less than 1.5 gallons per minute. The control module 12 monitors the flow rate of water from the tank 14 to ensure that the water disposed within region 15 is at a high enough temperature to allow the upper heating element 16 to heat the cooler water to the set point temperature prior to the water being drawn at the outlet 22.

The flow of water out of the tank 14 can be determined by either employing a flow sensor 37 at either the inlet 20 or the outlet 22 or by monitoring the upper or lower temperature sensors 36, 38. The flow sensor 37 can be disposed at either the inlet 20 or the outlet 22, but is preferably disposed at the inlet 20 to avoid potential corruption of the sensor 37 caused by hot water.

The temperature sensors 36, 38 could also provide information regarding water flow as each realizes a dramatic change in temperature as water is drawn from the tank 14.

Specifically, the upper temperature sensor 36 senses a temperature change when water at the set point temperature is drawn and replaced by water at the cooler setback temperature (i.e., from region 15). Similarly, the lower temperature sensor 38 senses a temperature change when water from building water supply 24 enters the tank 14 at the inlet 20. In this manner, either sensor 36, 38 is therefore capable of providing information indicative of water being drawn from the tank 14.

If water is not being drawn from the tank 14 or the water at the upper temperature sensor 38 is not less than, or equal to, the set point temperature plus the differential, the upper heating element 16 is de-energized (if currently energized) at 70 and the lower temperature sensor 38 is read at 72. The reading at the lower temperature sensor 38 is compared to the set point temperature minus the setback temperature at 74. If the temperature at the lower temperature sensor 38 is not greater than the set point temperature minus the setback temperature, the lower heating element 18 is energized at 76. If the temperature at the lower temperature sensor 38 is greater than the set point temperature minus the setback temperature, the lower heating element 18 is de-energized (if currently energized) at 78.

In this manner, the control module 12 optimizes the efficiency of the water heater 10 by maintaining only the water disposed within the upper portion of the tank 14 (i.e., region 13) at the set point temperature and maintaining the larger volume of the tank 14 (i.e., region 15) at a cooler temperature. The cool temperature not only saves energy in that less heat is lost through walls of the tank 14 but also by heating only that which is drawn from the tank 14 to the set point temperature. Therefore, the control module 12 of the present invention optimizes the efficiency of the water heater 10 and reduces energy costs associated with operation thereof while concurrently maintaining the requisite effective capacity requirements dictated by the consumer.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An electric water heater comprising:

a tank defining a volume;

a water inlet fluidly coupled to said tank;

a water outlet fluidly coupled to said tank;

at first heating element extending into said tank and disposed proximate to said inlet;

a second heating element extending into said tank and disposed proximate to said outlet; and a control module operable to maintain a stratification of water within said tank, said stratification including a first volume maintained at a set point temperature and a second volume held at a setback temperature that is less than said set point temperature;

wherein said setback temperature is low enough to maintain the stratification and high enough to allow said second heating element to heat water from said second volume to said set point temperature prior to exiting said tank at said outlet.

2. The electric water heater of claim 1, wherein said setback temperature is equal to at least 10 degrees Fahrenheit less than said set point temperature.

3. The electric water heater of claim 1, further comprising a sensor module, said sensor module receiving event messages from at least one sensor for input into said control module.

4. The electric water heater of claim 3, further comprising at least one sensor in communication with said control module.

5. The electric water heater of claim 4, wherein said at least one sensor is a temperature sensor.

6. The electric water heater of claim 4, wherein said at least one sensor is a flow sensor.

7. The electric water heater of claim 6, wherein said flow sensor is disposed at said inlet.

8. The electric water heater of claim 6, wherein said flow sensor is disposed at said outlet.

9. A control system for an electric water heater having an upper heating element and a lower heating element, the control system comprising:

a control module that controls operation of the electric water heater by selectively toggling the upper and lower heating elements between an ON state and an OFF state; and a consumer interface module that allows a consumer to input a set point temperature for the electric water heater;

wherein said control module is operable to maintain a stratification of water within said tank, said stratification including a first volume maintained at a set point temperature and a second volume held at a setback temperature that is less than said set point temperature;

wherein said setback temperature is low enough to maintain the stratification and high enough to allow said second heating element to heat water from said second volume to said set point temperature prior to exiting said tank at said outlet.

10. The control system of claim 9, wherein said setback temperature is equal to at least 10 degrees Fahrenheit less than said set point temperature.

11. The control system of claim 9, wherein said consumer interface module includes a visual display.

12. The control system of claim 11, wherein said visual display includes at least one of a light-emitting device and a liquid crystal display.

13. The control system of claim 9, further comprising a relay module, said relay module disposed generally between said control module and the upper and lower heating elements, said relay module delivering instructions from said control module to the upper and lower heating elements.

14. The control system of claim 9, wherein said control module includes a microcontroller.

15. The control system of claim 9, further comprising a sensor module, said sensor module receiving event messages from at least one sensor for input into said control module.

16. The control system of claim 15, further comprising at least one sensor in communication with said control module.

17. The control system of claim 16, wherein said at least one sensor is a temperature sensor.

18. The control system of claim 16, wherein said at least one sensor is a flow sensor.

19. The control system of claim 18, wherein said flow sensor is disposed at said inlet.

20. The control system of claim 18, wherein said flow sensor is disposed at said outlet.

21. A method for controlling an electric water heater comprising:

filling the water heater with water;

setting a set point temperature;

energizing an upper heating element to heat a first volume of water disposed above said upper heating element to a set point temperature;

de-energizing said upper heating element once said set point temperature is achieved;

energizing a lower heating element to heat a second volume of water disposed between said lower heating element and said upper heating element to a temperature at least 10 degrees Fahrenheit less than said set point temperature.

22. The method of claim 21, further comprising determining when water is drawn from said first volume of water.

23. The method of claim 22, further comprising energizing said upper heating element when water from said first volume of water is drawn to heat water from said second volume of water to said set point temperature.

24. A method for controlling an electric water heater comprising:

filling the water heater with water;

setting a set point temperature;

energizing an upper heating element to heat a first volume of water disposed above said upper heating element to a set point temperature;

de-energizing said upper heating element once said set point temperature is achieved;

energizing a lower heating element to heat a second volume of water disposed between said lower heating element and said upper heating element to a temperature at least 10 degrees Fahrenheit less than said set point temperature;

energizing said upper heating element when water is drawn from the water heater and water from said second volume of water contacts said upper heating element to heat said water from said second volume of water to said set point temperature.

25. The method of claim 24, further comprising sensing a flow of water entering the water heater at an inlet.

26. The method of claim 24, further comprising sensing a flow of water exiting the water heater at an outlet.

27. The method of claim 24, further comprising sensing a flow of water from the water heater by monitoring a sensor module, said sensor module having at least one temperature sensor disposed at each of said upper heating element and said lower heating element.

* * * * *